US006533841B1

(12) United States Patent
Jepsen

(10) Patent No.: US 6,533,841 B1
(45) Date of Patent: Mar. 18, 2003

(54) METHOD AND RINSING EQUIPMENT FOR THE CLEANING OF ESPECIALLY FILTER PLATES IN AN ELECTRO-FILTER

(75) Inventor: Erik Lund Jepsen, Værløse (DK)

(73) Assignee: Toftejorg A/S, Ishof (DK)

( * ) Notice: Subject to any disclaimer, the term of this patent is extended or adjusted under 35 U.S.C. 154(b) by 0 days.

(21) Appl. No.: 09/446,568

(22) PCT Filed: Jun. 29, 1998

(86) PCT No.: PCT/DK98/00285

§ 371 (c)(1),
(2), (4) Date: Mar. 6, 2000

(87) PCT Pub. No.: WO99/01224

PCT Pub. Date: Jan. 14, 1999

(30) Foreign Application Priority Data

Jun. 30, 1997 (DK) ..... 0774/97

(51) Int. Cl.[7] ..... B03C 3/78
(52) U.S. Cl. ..... 95/75; 96/44; 96/46; 96/50
(58) Field of Search ..... 95/75; 96/46, 44, 96/50, 47

(56) References Cited

U.S. PATENT DOCUMENTS

| | | | | |
|---|---|---|---|---|
| 1,399,441 A | | 12/1921 | Petersen | 96/43 |
| 2,874,802 A | * | 2/1959 | Gustafsson et al. | 96/44 X |
| 2,998,098 A | | 8/1961 | McNall, Jr. et al. | 96/46 |
| 3,257,778 A | | 6/1966 | Flagg | 96/46 |
| 3,464,185 A | | 9/1969 | Fields | 96/46 |
| 3,505,786 A | * | 4/1970 | Revell et al. | 96/46 |
| 5,221,297 A | | 6/1993 | Childress et al. | 95/75 |

FOREIGN PATENT DOCUMENTS

| | | | | |
|---|---|---|---|---|
| JP | 4-176346 | * | 6/1992 | 96/50 |
| JP | 6-31202 | * | 2/1994 | 96/44 |

* cited by examiner

*Primary Examiner*—Richard L. Chiesa
(74) *Attorney, Agent, or Firm*—William J. Sapone; Coleman Sudol Sapone, P.C.

(57) ABSTRACT

Filter plates in an electro-filter are cleaned using nozzles which, during spraying, are displaced longitudinally with the side edges of the filter plates while at the same time being rotated. The nozzles are mounted in a plane slightly different from the plane of the filter plates to enable the spray jets to reach the furthermost areas of the plates when the nozzles are at the greatest angle of incidence during washing.

8 Claims, 2 Drawing Sheets

Figure 1:
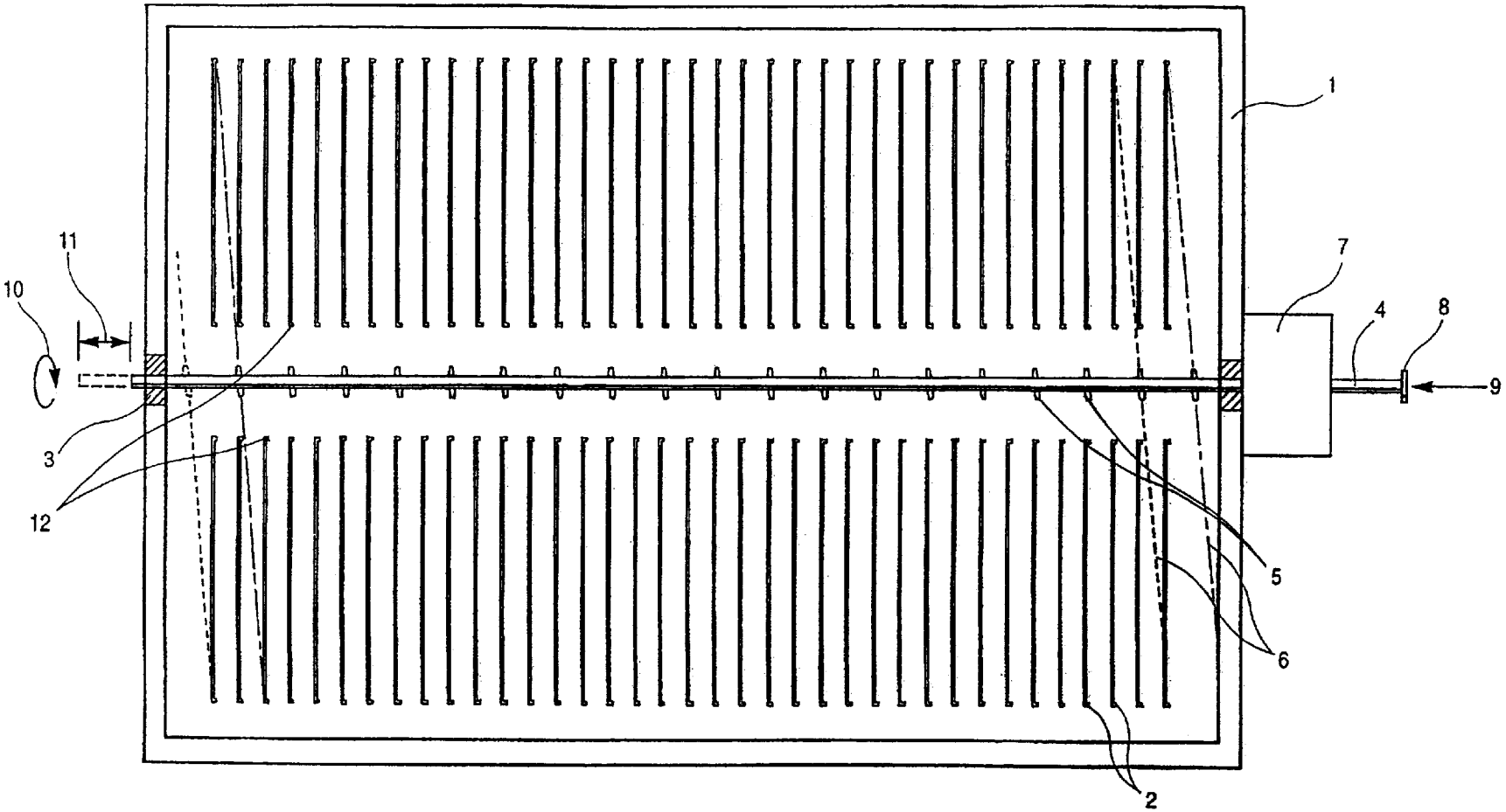

METHOD AND RINSING EQUIPMENT FOR THE CLEANING OF ESPECIALLY FILTER PLATES IN AN ELECTRO-FILTER

This application is a national stage of a PCT International Patent application no. PCT/DK98/00285, filed on Jun. 29, 1998.

PRIOR ART TECHNIQUE

The invention concerns a method for the rinsing of especially filter plates for fly ash in an electro-filter built into a filter housing, by means of a cleaning medium which under pressure is sprayed on the plates via movable nozzles, whereby the plates are cleaned.

An electro-filter comprises a filter housing in which one or more rows of mutually parallel filter plates are mounted, and which are electrically charged for the trapping of dust particles which are contained in the flue gas which is led through the filter housing.

These dust particles, fly ash, are loosened from the plates by mechanical means and are precipitated so that they can subsequently be removed.

However, the filter must be periodically inspected, which is why the insides of the filter housing such as the plates must be thoroughly cleaned of dust before personnel can be sent inside to carry out the inspection. If such a cleaning has not been effected, the personnel will be exposed to a considerable health risk due to the dust.

The result is that considerable costs are connected with this thorough cleaning, which in turn involves great operational losses due to the relatively long period of time required for the cooling and the cleaning of the filter.

Normally, the cleaning is effected manually while maintaining strict security precautions and the use of respirators, protective clothing etc.

In order to remedy these disadvantages, efforts are made to mechanise and automate this cleaning as much as possible.

From the description of U.S. Pat. No. 5,221,297, an example of a cleaning plant is known which can rinse the filter plates in the filter housing without manual assistance.

The plant comprises a nozzle arrangement which, from the one side of the plates, sprays the plates with a diffuse jet from spray nozzles, and a reflection arrangement extending at the opposite side of the plates which reflects the jets so that all areas on the sides of the plates are rinsed as clean as possible.

Both the nozzles and the reflectors are moved in a synchronous manner by means of a co-operating chain drive.

However, this plant is not particularly efficient, and with the comprehensive chain drive for both nozzles and reflectors it constitutes a very complicated construction. Moreover, the mechanical parts are disposed inside the filter housing where they are exposed to the aggressive dust, which means that the mechanical parts must be made of expensive materials. The plant is therefore vulnerable and subject to operational disturbances because of the dust which is deposited on the driving mechanism.

From the description of U.S. Pat. No. 1,399,441, a plant is known for the cleaning of filter plates by means of cleaning fluid, gas, which via movable nozzles is directed towards the electrode in the form of an even stream or possibly in a pulsating manner.

However, this plant is unable to clean the filter housing of dust in a manner whereby the insides of the housing can be inspected without risk. Consequently, a further thorough cleaning is necessary so that the dust can be removed to such an extent that the inspection can take place.

THE OBJECT OF THE INVENTION

The object of the invention is to overcome the drawbacks and disadvantages of the cleaning plants of this kind, and this is achieved according to the invention by a method whereby the cleaning medium consists of water, and the nozzles are displaced a given distance along the side edge of the filter plates while at the same time the nozzles are rotated.

In a surprisingly simple manner, there is hereby achieved a washing of the plates which is very effective and herewith water-saving.

The rinsing with cleaning water is effective due to the relatively great kinetic energy of the water, and the dust is bound by and flushed out with the water.

This makes it possible for the filter housing to be inspected without any need for a preceding further cleaning.

Furthermore, the method ensures that the nozzles are moved a given distance longitudinally with the plates during simultaneous rotation. The total movement of the nozzles provides a progressive rinsing, in that the concentrated jets will form a concentric jet path on the plates. There is hereby achieved the best possible cleaning effect, in that the circular strokes assume rising and falling radii during the movement. The rinsing interval is reduced to the shortest possible period of time, and at the same time herewith the water consumption falls to a minimum, in that water is not wasted on surfaces already cleaned. The setting and the adjustment of the displacement and rotation of the nozzles ensures that both the consumption of water and cleaning time become minimal.

By letting the nozzles spray the rear and the front of the plates during their movement, a uniform and effective cleaning of the plates is achieved.

By configuring the rinsing equipment as a pipe on which the nozzles are mounted, and by displacing the pipe during its simultaneous rotation, and by mounting the drive unit and the water supply pipe outside the filter housing, an operationally reliable plant is achieved in an efficient manner, in that all mechanical parts are disposed outside the filter housing, and are thus not exposed to disturbing influences from the dust.

By mounting the nozzles on the pipe in pairs, and at least a distance between the nozzles corresponding to the displacement of the pipe, an effective cleaning of the plates can be ensured, in that all the plates are sprayed in a completely uniform manner.

By mounting the nozzle pairs in a plane which forms an angle with the plane of the plates which corresponds to the spraying of the furthermost areas on the plates, during the rotation a spreading of the jets will be achieved which, during the greatest possible angle of incidence, results in a jet direction directed both forwards and rearwards in relation to the direction of displacement.

By setting the displacement and the rotation so that the jet path assumes a mutually uniform distance, a highly efficient cleaning of the plates is achieved.

By letting the displacement correspond to a whole number of spaces between the plates, a compact construction of the equipment will be achieved, which at the same time results in a high efficiency and a minimum consumption of power and water.

Finally, it is advantageous to use the equipment for washing the plate elements corresponding to plate elements in an electro-filter.

THE DRAWING

Figure 3:
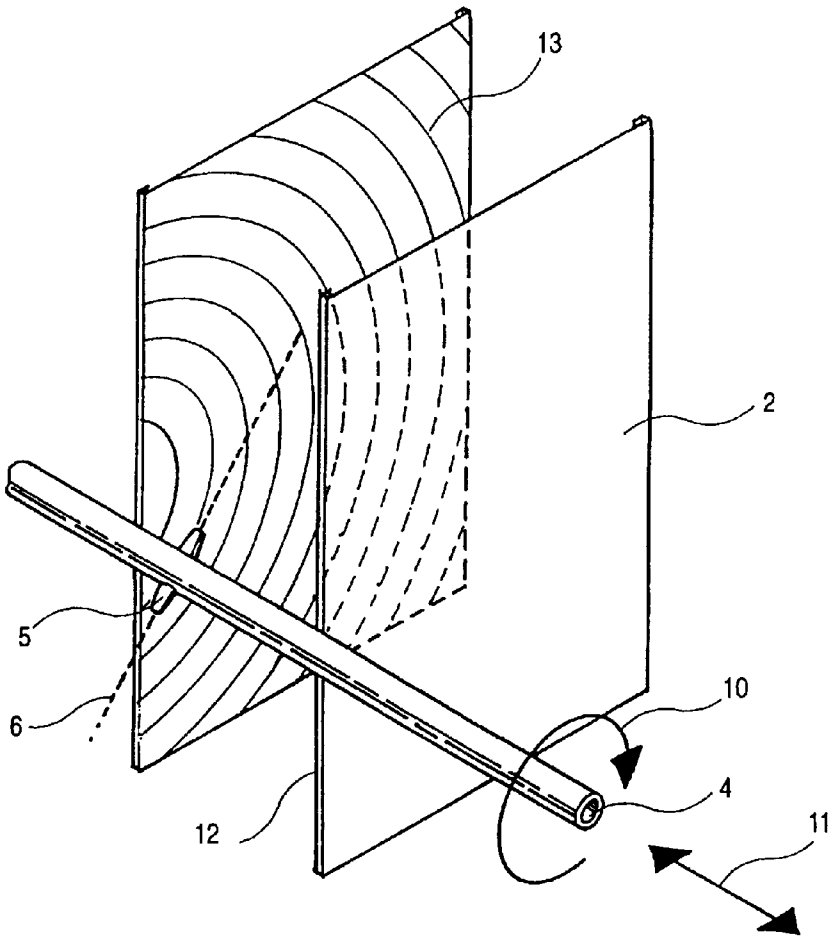
Figure 2:
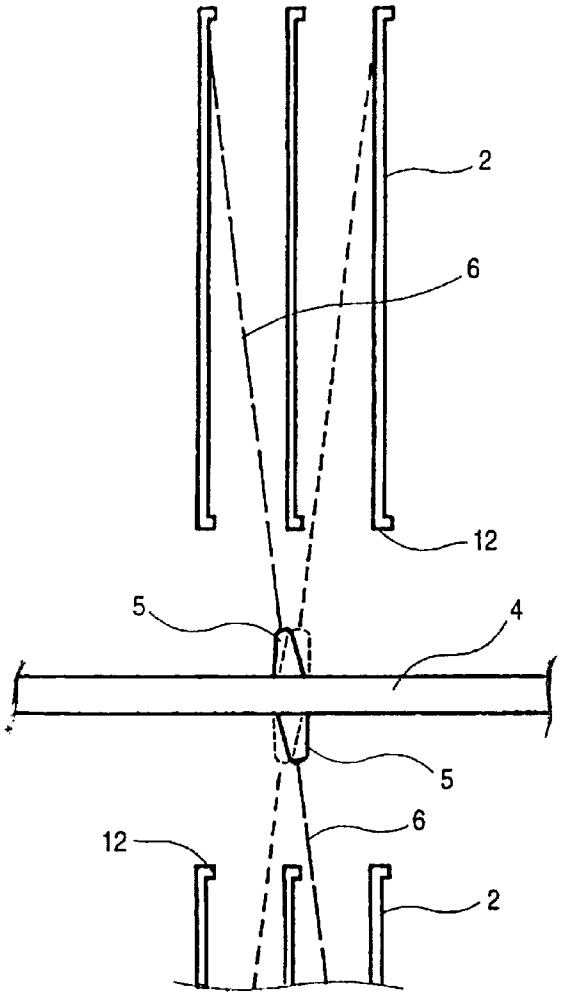

In the following section, an example of the method and embodiment of the equipment will be described in more detail with reference to the drawing, where FIG. 1 shows a filter seen from the above with two rows of plates and an intermediate nozzle pipe, FIG. 2 shows a nozzle pair seen from above during cleaning, and FIG. 3 shows in perspective the jet path on a filter plate during cleaning.

DESCRIPTION OF EXAMPLE EMBODIMENTS

An example embodiment of cleaning equipment according to the invention will now be described with reference to FIG. 1, which shows an electro-filter seen from above, in that the top of the housing is removed. The filter is built into a closed, dust-proof filter housing 1 of a commonly-known kind. In this example, inside the housing there are mounted two rows of filter plates 2 in such a manner that they extend throughout the whole length of the housing, and with their side edges 12 on a line for the formation of an intermediate opening.

The plates 2 are mounted mutually parallel and with the same mutual distance for the formation of uniform spaces between the plates 2.

In the intermediate opening between the rows of plates, a pipe 4 is mounted in not-shown bearing brackets, said pipe extending through the housing's one wall which, as indicated in the drawing, can have built-in bearings 3.

The pipe 4 is connected to driving means which are built into a drive unit 7 which is mounted on the outside of the housing. These driving means move the pipe both for displacement in the axial direction, as indicated by the arrow 11, and for the rotation as indicated by the arrow 10.

Nozzles 5 are mounted on the pipe 4, said nozzles being oppositely directed as indicated in the drawing.

Finally, as indicated in the drawing, cleaning water 9 is fed to the pipe 4 via an external connection 8.

When water 9 under pressure is fed to the pipe, the water will be sprayed out from the nozzles 5 in concentrated rinsing jets 6 as indicated by the stippled and dotted lines in FIG. 1.

The nozzle pairs 5 are mounted on the pipe 4 at mutual distances which can correspond to the distance between a number of plates 2 or whole spaces between the plates.

By arranging the amount of displacement 11 at the same distance, during the washing a nozzle pair will spray plates which face towards two spaces in both rows of plates, as indicated in the drawing.

In order to achieve the greatest possible cleaning effect, as indicated in FIG. 2 the nozzles 5 are mounted in an angular position in relation to a plane at right-angles to the centre axis of the pipe, so that the two oppositely-directed jets will extend in a plane which extends obliquely in relation to the plane of the plates. The angle is such that the jets 6 can reach the furthermost areas of the plates when the nozzles are moved during the washing with the greatest possible angle of incidence.

When the pipe 4 and herewith the nozzles 5 are rotated 180°, the jets 6 will spray opposite surfaces of the plates as indicated by stippled line. There will thus occur a spraying of the front and rear of the centremost plates, while the outermost plates will be sprayed on the one side and on their other side by the adjacent pair of jets.

The method will now be described with reference to FIGS. 2 and 3.

The washing can be initiated from outside, even though the filter has not yet been completely cooled down, so that the idle time is kept as short as possible, in that the inspection of the insides of the filter can be started shortly afterwards.

Water 9 under pressure is fed to the pipe 4, while at the same time the driving unit 7 is started for the movement of the pipe with the nozzles 5. The nozzles are displaced sideways 11 and at the same time rotated 10. The plates are hereby sprayed in a cleaning pattern, such as that indicated in FIG. 3. Upon conclusion of the rinsing, the pipe can be moved back to the start position, after which the plant is ready for the next cleaning operation.

The impact of the jet 6 against the plate takes place in arcs or paths 8 which extend as concentric rings which start either close to or at a distance from the nozzle.

The plates are hereby sprayed in a completely uniform manner, and no unnecessary washing takes place, i.e. washing is effected only where there is need for it.

Since the jets extend from the oppositely-directed nozzles, spraying is effected in different directions, so that both the front and the rear of the plates are cleaned effectively.

The plant is dimensioned and manoeuvred in such a manner that the greatest possible effect is achieved, and with the smallest possible consumption of water and time. It can be an advantage for the control of the plant to be programmed automatically by means of commonly-known computer equipment.

Where, for example, the plate area is large, additional pipes with nozzles can be mounted so that all surfaces are uniformly and effectively cleaned. Washing will thus be able to be effected with crossing jets from oppositely-directed nozzles on pipes which extend on the plates' opposite sides, which provides an effective cleaning of plate bends, corners and similar areas to which access is difficult.

Washing equipment of this kind is suitable for the cleaning of corresponding surfaces in plants which comprise similar plate elements.

What is claimed is:

1. A method for cleaning a plurality of filter plates which are used to capture fly ash in an electro-filter built into a filter housing comprising:

providing water under pressure in a pipe;

providing a plurality of nozzles on the pipe in fluid communication with the pressurized water for issuing a jet of pressurized water therefrom;

mounting the nozzles on opposite sides of the pipe in a plane which deviates slightly at an oblique angle from a plane of the plates; and displacing the pipe and nozzles to a given extent along the side edges of the filter plates while simultaneously rotating the nozzles such that the pressurized water is sprayed on the plates at an angle of incidence such that the furthermost areas on the sides of the plates are sprayed, thereby cleaning the plates.

2. The method according to claim 1, further comprising providing a rotatable and displaceable pipe, the plurality of nozzles mounted thereon, and driving the pipe using drive means located outside of the filter housing which are connected to the pipe for rotatably and displaceably driving the pipe.

3. The method according to claim 1 further comprising spraying both sides of the filter plates during movement of the nozzles.

4. An apparatus for cleaning a plurality of filter plates disposed in a filter housing, the filter plates used to capture fly ash in an electro-filter built into a filter housing, the apparatus comprising a rotatable and displaceable pipe having a plurality of nozzles thereon for issuing a plurality of jets of spray therefrom, the pipe in fluid communication with a pressurized cleaning medium, the pipe located in the filter housing along a side edge of the plurality of the filter plates, means for rotatably and displaceably driving the pipe located outside of the filter housing; and, the nozzles mounted on opposite sides of the pipe in a plane which deviates slightly at an oblique angle from a plane of the filter plates, such that during displacement the jets from the nozzles issue at an angle of incidence whereby the pressurized spray reaches the furthermost areas on the sides of the filter plates.

5. The apparatus of claim 4, wherein the plates are mounted mutually parallel and at a predetermined distance relative to each other.

6. Rinsing equipment according to claim 4, characterized in that the nozzles (5) are mounted in pairs on the pipe (4) and with a distance between adjacent nozzle pairs (5) corresponding to the displacement (11) of the pipe (4).

7. Rinsing equipment according to claim 4, characterized in that the displacement (11) and the rotation (10) of the pipe (4) are such that the jet path (13) extends as arcs with substantially the same mutual distance on the plates (2).

8. Rinsing equipment according to claim 4, characterized in that the amount of displacement (11) of the pipe (4) and herewith the nozzle (5) corresponds to the extent of a whole number of spaces between the plates, and that the pair-mounted nozzles (5) are mounted at a certain mutual distance.

* * * * *